United States Patent [19]

Lee et al.

[11] 4,330,598

[45] May 18, 1982

[54] REDUCTION OF LOSS OF ZINC BY VAPORIZATION WHEN HEATING ZINC-ALUMINUM COATINGS ON A FERROUS METAL BASE

[75] Inventors: Harvie H. Lee, Flossmoor, Ill.; Yong-Wu Kim, Munster, Ind.

[73] Assignee: Inland Steel Company, Chicago, Ill.

[21] Appl. No.: 157,373

[22] Filed: Jun. 9, 1980

[51] Int. Cl.[3] ..... B32B 15/18; B05D 1/10; B05D 1/28; B05D 3/02

[52] U.S. Cl. ..... 428/653; 427/34; 427/192; 427/194; 427/428; 427/433; 428/659; 428/939

[58] Field of Search ..... 428/562, 653, 659, 939, 428/553-556; 427/211, 34, 192, 194, 431, 433, 436, 428

[56] References Cited

U.S. PATENT DOCUMENTS

| | | | |
|---|---|---|---|
| 3,149,928 | 9/1964 | Schrader | 428/659 |
| 3,325,282 | 6/1967 | Mayer et al. | 428/653 |
| 3,343,930 | 9/1967 | Borzillo et al. | 428/653 |
| 3,782,909 | 1/1974 | Cleary et al. | 428/653 |
| 3,881,880 | 5/1975 | Gomersall | 428/684 |
| 3,905,780 | 9/1975 | Jasper et al. | 75/124 |
| 4,123,261 | 10/1978 | Moren et al. | 428/659 |
| 4,144,378 | 3/1979 | Kim | 428/653 |
| 4,264,684 | 4/1981 | Allegra et al. | 427/433 |

FOREIGN PATENT DOCUMENTS 1391659 2/1965 France .

*Primary Examiner*—Michael L. Lewis
*Attorney, Agent, or Firm*—Merriam, Marshall & Bicknell

[57] ABSTRACT

The loss of zinc by vaporization when heating a zinc-aluminum coating to a temperature between about 427° C. and 816° C. (800° F. and 1500° F.) is significantly reduced by applying a zinc-aluminum coating containing about 30 to 75 weight percent zinc and the balance essentially aluminum to a mild carbon steel base which contains titanium in an amount sufficient to combine with all of the carbon in the steel and provide a small excess of uncombined titanium in the steel base, thereby providing a zinc-aluminum coated steel article which has improved corrosion and oxidation resistance when heated at temperatures between about 427° C. and 816° C. (800° F. and 1500° F.).

10 Claims, 6 Drawing Figures

REDUCTION OF LOSS OF ZINC BY VAPORIZATION WHEN HEATING ZINC-ALUMINUM COATINGS ON A FERROUS METAL BASE

The present invention relates generally to providing a ferrous metal surface which is resistant to corrosion and oxidation and more particularly to a steel strip having a zinc-aluminum protective coating on a surface thereof which exhibits improved adherence and increased resistance to corrosion and to oxidation after being heated to a temperature above the melting point of zinc.

In order to protect a ferrous metal surface against attack when the ferrous metal surface is exposed to a corrosive and oxidizing environment it has been common practice to provide a protective surface coating containing metallic zinc and aluminum. Metallic zinc is sacrifical toward iron and is particularly useful in protecting a ferrous metal surface against attack by corrosive metal salt solution or by an acidic environment, while aluminum is particularly adapted to protect a ferrous metal against surface oxidation and exposure to an environment containing chloride ions. Protective zinc-aluminum surface coatings containing relatively large amounts of both zinc and aluminum ranging from about 30 to 75 percent by weight zinc with the balance mainly aluminum provide coatings which have improved corrosion and oxidation resistance when subjected to the Muffler Condensate Test relative to conventional galvanized material (see U.S. Pat. No. 3,343,930).

When a steel strip having a zinc-aluminum surface coating of the foregoing type is heated to a temperature above the melting point of zinc which is about 419° C. (786° F.), however, the zinc in the coating begins to vaporize. Thus, when a coating containing 43% zinc, 55% aluminum and about 2% silicon is heated at a temperature of about 482° C. (900° F.), it has been found that the zinc in the coating is lost by vaporization, the surface becomes very uneven and the coating weight and thickness is reduced proportional to the loss of zinc. Also, when the zinc-aluminum coating is heated at a temperature of about 650° C. (1200° F.) a continuous porous subsurface intermetallic compound layer is formed which further reduces the adherence of the surface coating and the corrosion and oxidation resistance of the coating is greatly reduced. Surface degradation and localized pitting of the zinc-aluminum coatings and oxidation of the ferrous metal surface becomes evident when the coated ferrous metal is heated at a temperature of about 816° C. (1500° F.). The loss of the zinc from these coatings, a reduction in the overall integrity of the coatings and a lowering of the ability of the coatings to withstand corrosion and oxidation are significant after heating the zinc-aluminum coatings at moderately elevated temperatures from about 427° C. to about 816° C. (800° F.-1500° F.).

It is therefore an object of the present invention to provide a zinc-aluminum coated ferrous metal article which has improved resistance to a corrosive and oxidizing environment after being heated at a temperature between about 427° C. (800° F.) and 816° C. (1500° F.) and to the method of providing said article.

It is a further object of the present invention to provide a zinc-aluminum coated ferrous metal strip which has improved resistance to a corrosive and oxidizing environment after being heated at a temperature between about 427° C. (800° F.) and above without requiring a large amount of an expensive alloying element in the protective coating or in the ferrous metal forming the strip and to the method of providing said strip.

Other objects of the invention will be apparent to those skilled in the art from the detailed description and claims to follow when read in conjunction with the accompanying drawing, wherein:

Figure 1:
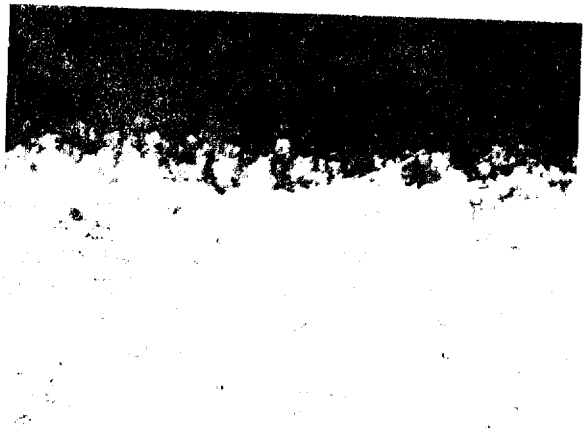
FIG. 1 is a photographic reproduction of a photomicrograph (500×) of a vertical section of a rimmed steel strip containing titanium in accordance with the present invention having a hot-dip coating formed of 43 wt. percent zinc, 55 wt. percent aluminum and 2.0 wt. percent silicon after heating 72 hours at 482° (900° F.).

The cross-section surfaces of the strips corresponding to the photomicrographs of FIGS. 1, 2, 5 and 6 were etched with a 4 percent solution of nital.

It has been found that the loss of a substantial amount of zinc from zinc-aluminum coatings containing between about 30 and 75 wt. percent zinc and with the balance being mainly aluminum along with preferably a small amount of silicon applied to a ferrous metal strip can be prevented when the strip is heated at a temperature between about 427° C. (800° F.) and 816° C. (1500° F.) and the objects of the present invention achieved in an economical manner by applying the said zinc-aluminum coatings to a low carbon low alloy ferrous metal base, such as a rimmed or an aluminum killed steel strip, where the steel contains as the essential alloying element titanium in an amount sufficient to combine with all of the carbon in the steel and provide a slight excess of uncombined metallic titanium distributed throughout the steel.

The titanium-containing plain carbon steel base preferably used in the present invention is a low carbon steel or mild steel having a carbon content of up to about 0.25 wt. percent max., usually from about 0.03 wt. percent to about 0.25 wt. percent and preferably from about 0.03 wt. percent to about 0.10 wt. percent, and having titanium added thereto in an amount which is sufficient to combine with all the carbon in the steel base and leave an excess of uncombined titanium. Typically, the plain carbon steel base will consist essentially of from about 0.03 wt. percent to about 0.25 wt. percent carbon and preferably from 0.03 wt. percent to 0.10 wt. percent, from about 0.20 wt. percent to about 0.50 wt. percent manganese, about 0.05 wt. percent max. silicon, titanium in an amount sufficient to combine with all the carbon in the steel base and leave an excess of uncombined titanium, and the balance iron with the usual amounts of impurities and residuals. Preferably, the steel is a killed steel, such as an aluminum killed steel, in which case the residuals or impurities present will include the usual amounts of aluminum or other deoxidizers, such as silicon, characteristic of killed steel. Although, as explained hereinafter, titanium is the essential alloying element to be added to the plain carbon base steel to obtain the advantages of the present invention, it is also within the scope of the invention to add small amounts of other metallic alloying elements to improve the physical properties of the base steel. However, the amount of such other metallic alloying elements should not exceed about 1 percent by weight and preferably should not exceed about 0.5 percent by weight. Thus, the steel articles of the present invention are, in any case, low alloy steel articles.

Preferably, the excess of uncombined titanium remaining in the steel is an amount between about 0.1 and about 0.3 percent by weight. Since the weight percent of titanium must be approximately four times the weight percent of carbon in the steel in order to combine with or precipitate essentially all the carbon and nitrogen in the steel in the form of titanium carbides or titanium carbo-nitrides. The minimum titanium content of the substrate steel sheet in the present invention should be four times the carbon content of the steel plus an additional amount of titanium sufficient to provide a slight excess of uncombined titanium. While the titanium content can be as much as ten times the weight percent of carbon in the steel, an amount of titanium greater than that required to provide from about 0.1 to about 0.3 percent by weight uncombined titanium gives no increased benefits and merely adds unnecessarily to the cost. And, since the amount of carbon in a steel conventionally used for producing zinc-aluminum coated steel strip is small, preferably less than 0.10 wt. percent, the total amount of titanium required in the present invention is small. The inclusion of titanium in the steel in the aforementioned amounts also results inherently in stabilization any nitrogen in the steel (usually not exceeding about 0.006 wt. percent) so that both the carbon and nitrogen are stabilized. The titanium carbides present provide improved high temperature tensile strength which prevents deformation of the steel and damage to the coating when the steel article is exposed to elevated temperatures.

The hot-dip zinc-aluminum coating bath must contain a sufficient amount of silicon to prevent the formation of an objectionably thick subsurface intermetallic layer during hot-dip coating which results in the coating having poor formability. The silicon content of the zinc-aluminum coatings should range between about 1.5 wt. percent and 6.0 wt. percent.

A low carbon aluminum killed titanium containing steel usable in the present invention can be made in a BOF or basic open hearth furnace according to the usual practice for producing a rimmed sheet steel. The steel having a low carbon content before tapping from the furnace is preferably killed in the ladle by adding aluminum in a conventional manner to effect thorough deoxidation of the steel. Thereafter, a quantity of titanium in the form of finely crushed commercially available ferro-titanium alloy containing 65 percent titanium, machined titanium chips or titanium sponge is added to the steel in an amount sufficient to combine with all of the carbon remaining in the steel and provide an excess of uncombined metallic titanium. For example, the above crushed ferro-titanium alloy is added at a rate of 175 pounds for each 24,000 pounds ingot poured. The titanium additions must be completed before any oxidizing slag appears on the surface of the steel.

The steel is then worked into sheets by the usual commercial method, as by the cold rolling into sheets having a thickness of about 0.04 inches with no special attention other than employing a low coiling temperature (i.e. about 1100° F.) in order to suppress the formation of a large grain titanium carbide precipitate and reducing excessive oxidation at the surface of the steel sheet.

A preferred method of coating a steel strip having the titanium content thereof in accordance with the present invention is by a hot-dip coating process generally known in the art as a Sendzimir-type process, wherein a continuous steel sheet or strip which is free of scale and rust is fed continuously from a coil through a furnace containing an oxidizing atmosphere maintained at a temperature between about 166° C. and 499° C. (330° F. and 930° F.) which burns off any oil residue on the surface of the strip and forms a thin surface oxide film. The oxide coated steel sheet then passes through a furnace containing a reducing atmosphere, such as the hydrogen-containing HNX atmosphere, having a temperature between about 816° C. and 982° C. (1500° F. and 1800° F.), whereby the oxide coating on the strip is reduced to form a surface layer of metal free of nonmetallic impurities to which molten aluminum readily adheres. Following the reducing step, the strip is fed into a hot-dip zinc-aluminum coating bath through a protective hood which prevents the reduced metal surface being oxidized before entering the coating bath. After leaving the hot-dip zinc aluminum coating bath, the coating thickness on the strip is regulated by a pair of oppositely disposed thickness-regulating jet wipers or rolls which produce a uniform thin zinc aluminum coating, and the strip is cooled by any suitable means. The zinc aluminum coated strip is then wound into a coil. Conventional Sendzimir-type process apparatus can be used in each of the processing steps.

The step of burning off the oil and oxidizable combustible material on the surface of the steel strip before the strip is subjected to the reducing atmosphere can be omitted, if desired, provided the strip is otherwise thoroughly cleaned, immediately prior to the reducing step, as by conventional alkaline cleaning and pickling.

The zinc-aluminum hot-dip coating bath used for coating the low alloy titanium containing low carbon steel has a melting point which ranges from about 524° C. to 660° C. (975° F. to 1220° F.) varying inversely with the concentration of zinc in the bath which can range from about 30% by wt. and 75% by wt. The hot-dip coating bath also contains between about 1.5 to 6.0 percent by weight silicon along with a small amount of lead and iron as incidental impurities or accumulations due to continuous contact with the steel strip during the hot-dip coating operation.

Reproductions of photomicrographs of a zinc-aluminum coated steel strip prepared in the above described manner after heating at a temperature of about 482° C. (900° F.) in air for a period of 3 days are presented in FIGS. 1 and 3 of the drawing, and for comparison purposes reproductions of photomicrographs of a conventional steel strip which does not contain any added titanium but having substantially the same zinc-aluminum coating applied in the same manner and heated under the same conditions as the strip of FIGS. 1 and 3 are shown in FIGS. 2 and 4.

Figure 2:
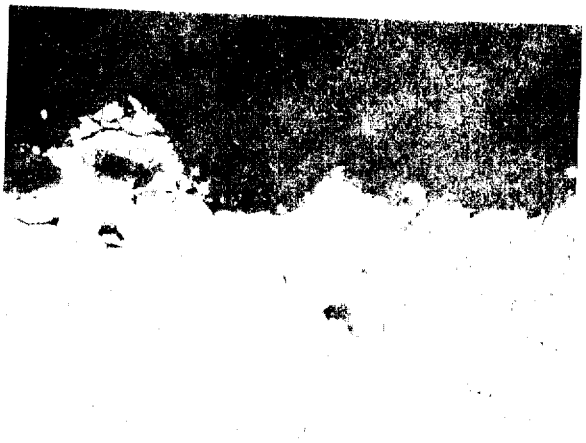
FIG. 2 is a photographic reproduction of a photomicrograph (500×) of a vertical section of a conventional rimmed steel strip having a hot-dip coating formed of 43.6 wt. percent zinc, 55 wt. percent aluminum and 1.7 wt. percent silicon after heating 72 hours at 482° C. (900° F.).

FIGS. 1 and 2 are vertical sections (500×) through the respective coated steel strips, and it is evident that the coating of FIG. 1 is much more uniform than the coating of FIG. 2.

Figure 3:
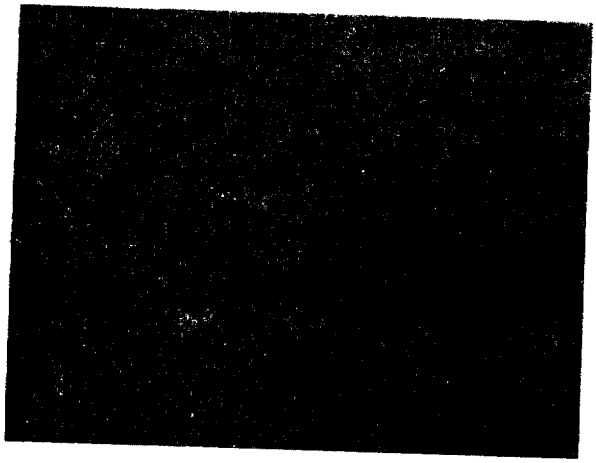
FIG. 3 is a photographic reproduction of a photograph (7.5×) of the surface of the strip of FIG. 1 after heating 72 hrs at 482° C. (900° F.).
Figure 4:
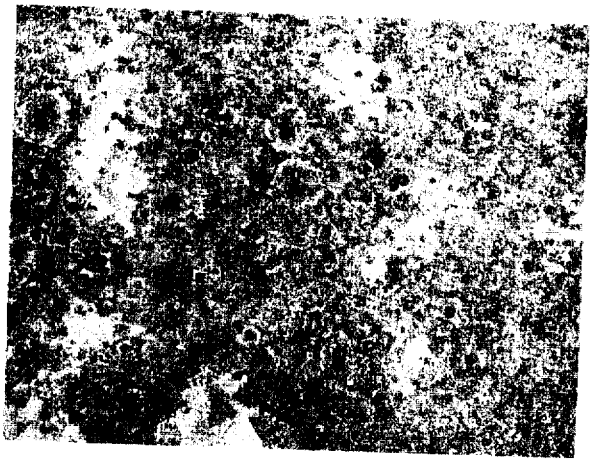
FIG. 4 is a photographic reproduction of a photograph (7.5×) of the surface of the strip of FIG. 2 after heating 72 hrs at 482° C. (900° F.).

FIGS. 3 and 4 show the surface (7.5×) of the strips of FIGS. 1 and 2, respectively, and it is evident that the strip of FIG. 3 has a uniform dull appearing surface, whereas the strip in FIG. 4 has an uneven bright appearing surface which contains numerous crators indicating a selective evaporation of zinc from the coating.

Figure 5:
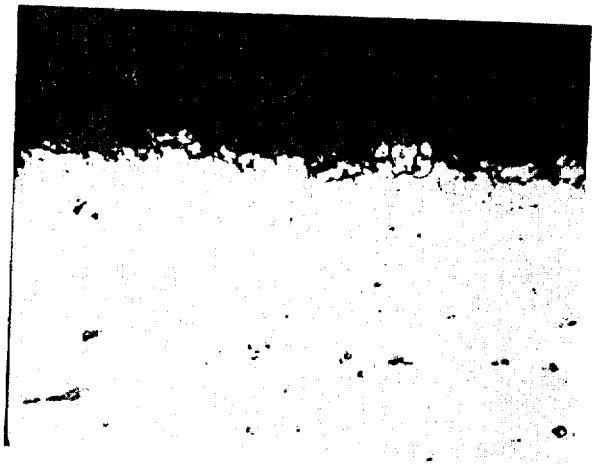
FIG. 5 is a photographic reproduction of a photomicrograph (500×) of a vertical section of a rimmed steel strip containing titanium in accordance with the present invention having a hot-dip coating formed of 43 wt. percent zinc, 55 wt. percent aluminum and 2.0 wt. percent silicon after heating at 650° C. (1200° F.) for 72 hours.
Figure 6:
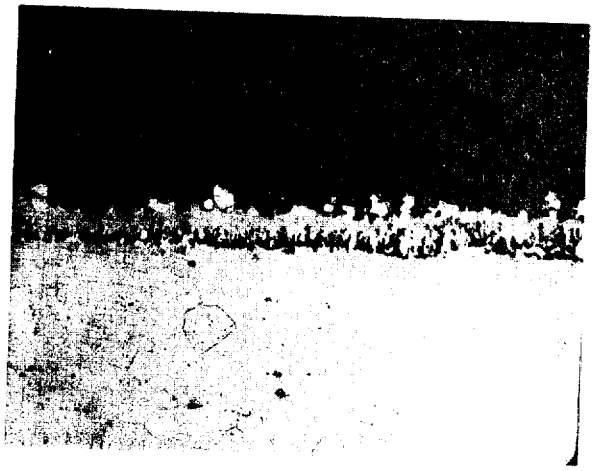
FIG. 6 is a photographic reproduction of a photomicrograph (500×) of a vertical section of conventional rimmed steel strip having a hot-dip coating formed of 43.6 wt. percent zinc, 55 wt. percent aluminum and 1.7 wt. percent silicon after heating at 650° C. (1200° F.) for 72 hours.

FIGS. 5 and 6 show vertical sections (550×) of the strips of FIGS. 1 and 2, respectively, after the strips have been heated at a temperature of 650° C. (1200° F.) for 3 days. From FIG. 5 it is evident that the coating has generally diffused uniformly into the steel base without forming a significant subsurface layer of intermetallic compound between the surface coating and the steel base. From FIG. 6 it is evident that the zinc-aluminum coating which is formed on a conventional steel base free of added titanium has formed a distinctly dark subsurface layer of intermetallic compound between the surface coating and the steel base. The surface coating also appears to have a reduced thickness relative to the coating of FIG. 5.

An important characteristic of the zinc-aluminum coated article of the present invention is the property of significantly reducing the loss of zinc from a zinc-aluminum coating by vaporization when the article is heated at temperatures only moderately above the melting point of zinc, and particularly at temperatures between about 427° C. and 538° C. (800° F. and 1000° F.). The latter temperature range is the temperature range within which most of the components of an automotive exhaust system are repeatedly heated during use.

Studies of the weight change effected in a zinc-aluminum coating(1) on a low titanium alloy steel strip prepared in accordance with the present invention (Specimen A) and a conventional steel strip which does not contain titanium (Specimen B) but having substantially the same zinc-aluminum coating(2) were made by heating the coated strips in air at a temperature of 482° C. (900° F.) for the indicated periods and the weight gain or loss were observed at the end of each period. The results observed are shown in the following Table I:

TABLE I

| | Weight Change Data (ug/cm²) | | |
|---|---|---|---|
| Specimen | 3-Days (900° F.) | 6-Days (900° F.) | 10-Days (900° F.) |
| A | +92 | +51 | −66 |
| B | −258 | −745 | −870 |

(1) 43% Zn, 55% Al, 2.0% Si, all % by wt.
(2) 43.6% Zn, 55% Al, 1.6% Si, all % by wt.

It will be evident from the data of Table I that there is a substantially larger reduction in the weight of the Specimen B as compared with Specimen A and that the weight loss in Specimen B is not offset by oxidation of the coating even after prolonged heating of the strip.

The Specimens A and B were also heated at a temperature of 650° C. (1200° F.) and 816° C. (1500° F.) for a period of 3 days and the weight change effected are presented in the following Table II:

TABLE II

| | Weight Change Data (ug/cm²) | |
|---|---|---|
| Specimen | 3-days (1200° F.) | 3-days (1500° F.) |
| A | +528 | +1118 |
| B | +369 | +668 |

The data of Table II indicates that the weight gain which normally occurs due to oxidation is much less in Specimen B than in Specimen A.

The zinc-aluminum coated steel strip or sheet of the present invention is particularly suited for use in fabricating components of an automotive exhaust system, such as exhaust mufflers, inlet pipes, tail pipes, Y-pipe assemblies, and catalytic converters. The zinc-aluminum coated titanium containing steel article made in accordance with the present invention has substantially improved corrosion and oxidation resistance compared with a similarly coated conventional rimmed steel after being heated at moderately elevated temperatures of 472° C.-816° C. (800° F.-1500° F.) in addition to exhibiting good resistance to corrosion when exposed to an acidic and salt environment and good formability at ambient temperatures and having high tensile strength at elevated temperatures all of which are important in the manufacture and operation of automotive exhaust system components.

While the invention is in no way dependent on any theory of operation, it has been found that the weight loss which normally occurs when a zinc-aluminum coated rimmed steel strip is heated at 482° C. (900° F.) is due to the loss of zinc by vaporization, and it is thought that the varporization of zinc is reduced in the coated strip of the present invention when a zinc-aluminum coating containing a substantial proportion of zinc is heated at moderately elevated temperatures above the melting point of zinc, because the rate of diffusion of zinc into the titanium-containing low alloy steel which is used for the strip in the present invention is greater than the rate of vaporization of zinc at the said temperatures (the vapor pressure of zinc at 482° C. (900° F.) is 0.115 kPa ($1.14\times10^{-3}$ atm.)) so that a substantial amount of the zinc diffuses into the low titanium alloy steel surface before a substantial amount of zinc is lost by vaporization. In a conventional rimmed steel having a like zinc-aluminum coating, the zinc is vaporized before there is substantial diffusion of zinc into the steel base, and a porous aluminum coating structure is formed on the surface of the strip having a reduced zinc concentration as well as significantly reduced adherence and resistance to corrosion and oxidation after prolonged heating at said moderately elevated temperatures.

While the zinc-aluminum coating is preferably applied by hot-dip coating, the coatings can be applied by other coating means, such as plasma spray coating or by roll coating a zinc-aluminum powder mixture dispersed in a suitable liquid vehicle.

We claim:

1. A corrosion and oxidation resistant zinc-aluminum coated low-alloy ferrous metal strip comprising; a low-alloy low-carbon steel strip containing between about 0.03 to 0.1 wt.% carbon having titanium as an essential alloying element in an amount which combines with all the carbon and nitrogen in the steel and provides an excess of uncombined metallic titanium distributed throughout the steel, said strip having a hot-dip zinc-aluminum surface coating consisting essentially of between about 43 wt.% zinc and about 55 wt.% aluminum and about 2 wt.% silicon, and said coating being resistant to the loss of zinc from the coating when the coating is heated at a temperature above the melting point of zinc to between about 427° C. (800° F.) and about 816° C. (1500° F.).

2. An article as in claim 1, wherein said excess of uncombined titanium is between about 0.1 and about 0.3 wt. percent of said steel.

3. An article as in claim 1, wherein said low carbon steel is a killed steel.

4. An article as in claim 1, wherein said steel is an aluminum killed steel containing between about 0.005 to about 0.09 wt. percent aluminum.

5. An article as in claim 1, wherein said low carbon steel contains between about 0.03 and 0.10 wt. percent carbon.

6. A method of providing a corrosion and oxidation resistant hot-dip zinc-aluminum coated ferrous metal strip which resists loss of zinc from a zinc-aluminum coating containing about 43 wt.% zinc and 55 wt.% aluminum when said coating is heated at a temperature above the melting point of zinc to between about 427° C. (800° F.) and 816° C. (1500° F.) which comprises; forming a strip of low alloy low carbon steel containing between about 0.03 to 0.1 wt.% carbon and having titanium as an essential alloying element present in an amount which combines with all of the carbon and nitrogen in the steel and providing an excess of uncombined metallic titanium distributed throughout the steel, and applying to a clean surface of said strip a hot-dip zinc-aluminum coating consisting essentially of about 43% zinc, about 55% aluminum and about 2 wt.% silicon.

7. A method as in claim 6, wherein said excess of uncombined metallic titanium is between about 0.1 and about 0.3 wt. percent of said steel.

8. A method as in claim 6, wherein said steel is a killed steel.

9. A method as in claim 6, wherein said steel is an aluminum killed steel containing between about 0.005 to about 0.09 wt. percent aluminum.

10. A method as in claim 6, wherein said steel containing between about 0.03 wt. percent and 0.10 wt. percent carbon.

* * * * *